US007214076B1

(12) United States Patent
Sabo

(10) Patent No.: US 7,214,076 B1
(45) Date of Patent: May 8, 2007

(54) CARD CONNECTOR WITH ANTI-MISMATING DEVICE

(75) Inventor: James M Sabo, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,150

(22) Filed: Jul. 3, 2006

(51) Int. Cl.
*H01R 13/44* (2006.01)

(52) U.S. Cl. ..... 439/138; 439/630

(58) Field of Classification Search ..... 439/140, 439/630, 151, 137, 138, 142
See application file for complete search history.

(56) References Cited

U.S. PATENT DOCUMENTS 5,035,633 A 7/1991 Kobayashi et al.
5,574,625 A * 11/1996 Ohgami et al. ..... 361/684
6,120,322 A * 9/2000 Ho et al. ..... 439/541.5
6,368,122 B2 * 4/2002 Billman ..... 439/138
6,887,087 B2 * 5/2005 Lai et al. ..... 439/138
7,044,757 B1 * 5/2006 Yen ..... 439/138
2006/0046542 A1 * 3/2006 Obara et al. ..... 439/135

* cited by examiner

*Primary Examiner*—Hae Moon Hyeon
(74) *Attorney, Agent, or Firm*—Wei Te Chung

(57) ABSTRACT

A card connector comprises an housing defining a pair grooves and a receiving space with a first entrance opening; first and second sets of contacts retained in the insulating housing and exposed in the receiving space; a protection door moveably covering the first entrance opening for receiving a first card and defining a second entrance opening smaller than the first entrance opening therein for receiving a second card; a pivotal door associated with the protection door to moveably cover the second entrance opening; and a positioning member having a respective positioning portion exposed into the groove. When the second card is inserted in the second entrance opening, the positioning portion of the positioning member moves to one end of the corresponding groove to prevent the protection door from opening.

20 Claims, 6 Drawing Sheets

CARD CONNECTOR WITH ANTI-MISMATING DEVICE

CROSS-REFERENCE TO RELATED APPLICATIONS

This application is related to copending U.S. patent application Ser. No. 11/095,277 filed on Mar. 30, 2005.

BACKGROUND OF THE INVENTION

1. Field of the Invention

The present invention is generally related to a card connector, and especially to a card connector with anti-mismating means for assuring different size/type cards can be correctly received in corresponding receiving spaces.

2. Description of Related Art

It is popular to provide one single Integrated Circuit (IC) card connector with different sets of terminals at different locations to engage the different size/type IC cards which mutually exclusively enter the common receiving space defined in the card connector via the same entrance opening. Understandably, the housing of the card connector provides some key/keyway in the guiding channels to guidably retain the inserted cards in position. However, sometimes a card of smaller dimensions may be inadvertently inserted into the entrance opening in an improper tilted manner that it may be incorrectly positioned, thus either damaging the terminals or being damaged by the terminals. The safest way is to provide different spaces and/or different entrance openings in the card connector, However this would increase the total thickness of the connector, which is opposite to the trend of miniaturization. Accordingly, it is desired to provide a safe structure for the card connector to regulate different cards' insertion and not increase the thickness of the card connector.

U.S. Pat. No. 5,035,633 discloses a protection member which is located at an entrance opening of the card connector and can be moved either linearly or pivotally to allow the corresponding card to be inserted into the card connector for mating under a condition that the protection member is controlled by a locking member which moveably and releasably locks the protection member which can be released by the inserted card when the correctly sized card is inserted into the card entrance opening.

However, sometimes a small sized card is still required to be inserted into the combo type card connector for mating with the corresponding contacts in the card connector. In order to overcome the limitations of the currently offered products, it is expected to modify the protection member aforementioned U.S. Pat. No. 5,035,633 which is capable of retaining a small sized card in position when the small sized card is inserted into the receiving space for mating with the corresponding terminals while not obstructing insertion of a large sized card.

Hence, an improved card connector is highly desired to overcome the aforementioned problem of the prior art.

SUMMARY OF THE INVENTION

Accordingly, an object of the present invention is to provide a card connector which has anti-mismating device to prevent card from mismating.

To achieve the above object, a card connector comprises an insulating housing defining a pair of grooves and a receiving space with a first entrance opening; first and second sets of contacts retained in the insulating housing and exposed in the receiving space; a protection door moveably covering the first entrance opening for receiving a first card and defining a second entrance opening smaller than the first entrance opening therein for receiving a second card; a pivotal door associated with the protection door to moveably cover the second entrance opening, and a positioning member having a respective positioning portion exposed into the groove. When the second card is inserted in the second entrance opening, the positioning portion of the positioning member moves to one end of the corresponding groove to prevent the protection door from opening.

Other objects, advantages and novel features of the present invention will be drawn from the following detailed description of a preferred embodiment of the present invention with attached drawings.

DETAILED DESCRIPTION OF THE INVENTION

Figure 1:
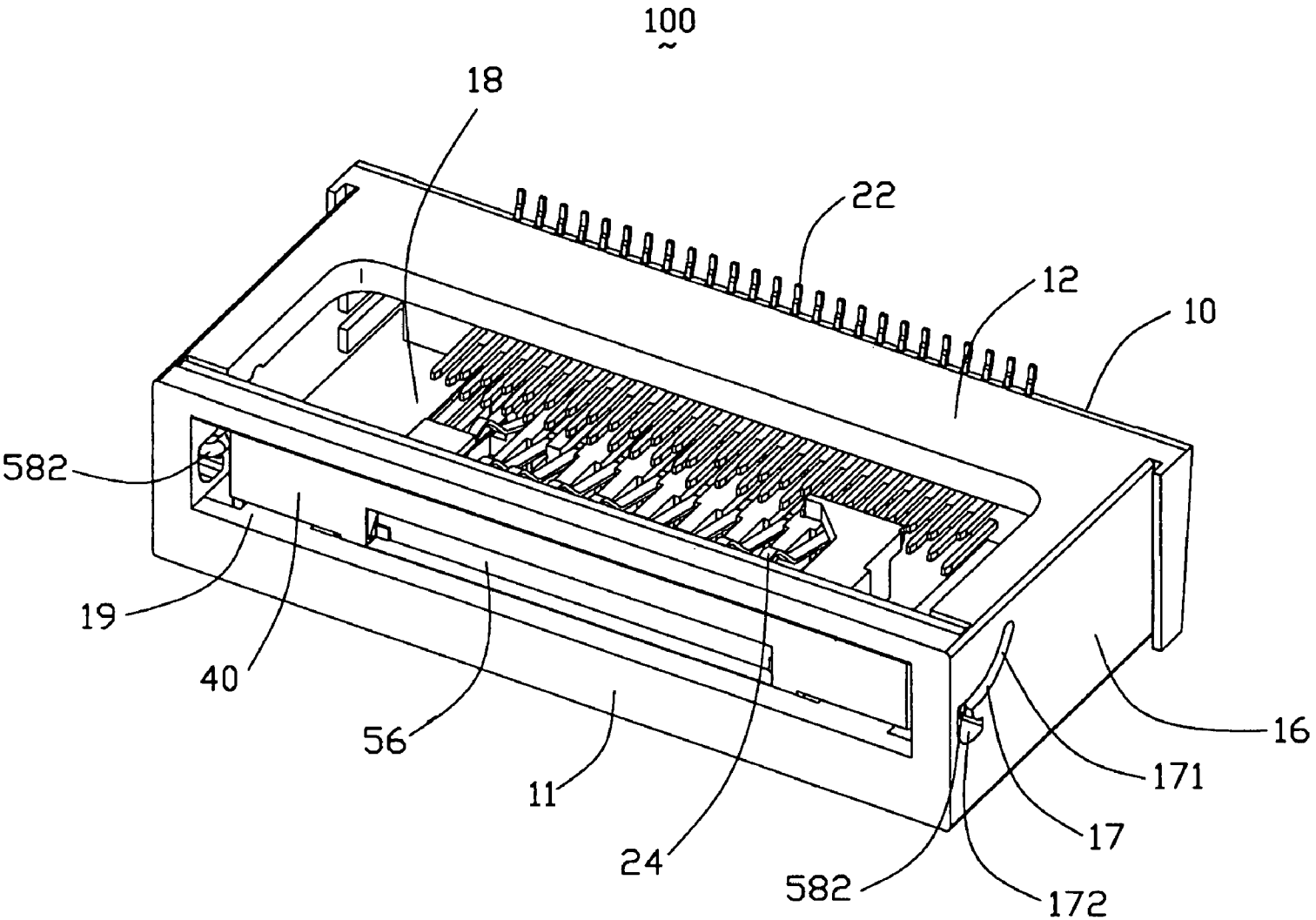
FIG. 1 is an assembled, perspective view of a card connector in accordance with the present invention.

Reference will now be made in detail to the preferred embodiment of the present invention.

Referring to FIGS. 1–6, the card connector in accordance with the present invention is adapted for receiving a first card 300, such as a Compact Flash (CF) card, and a second card, such as an Secure Digital (SD) card, is smaller than the first card 300 in size.

The card connector 100 comprises a connector housing 10 having opposite front wall 11 and rear wall 27, opposite top wall 12 and bottom wall 14, and opposite two side walls 16 commonly define a receiving space 18 in the connector housing 10. A first set of contacts 22 are disposed on the rear wall 27 and forwardly extending into the receiving space 18 for mating with the first card 300 (shown in FIG. 6). A second set of contacts 24 are disposed on the bottom wall 14 and upwardly extending above an upper face of the bottom wall 14 and into the receiving space 18 for mating with the second card. A first entrance opening 19 is formed in the front wall 11 of the housing 10 and in communication with the receiving space 18. The top wall 12 defines a pair of receiving recesses 121 recessed downwardly from a front end of an upper face thereof adjacent to the opposite sidewalls 16. Each of the sidewalls 16 defines a groove 17 having a first groove section 171 and a second groove section 172 communicating with and locating under the first groove section 171. The first and second groove sections 171, 172 are approximately arc configuration, respectively. The groove 17 is in communication with the receiving space 18.

Figure 2:
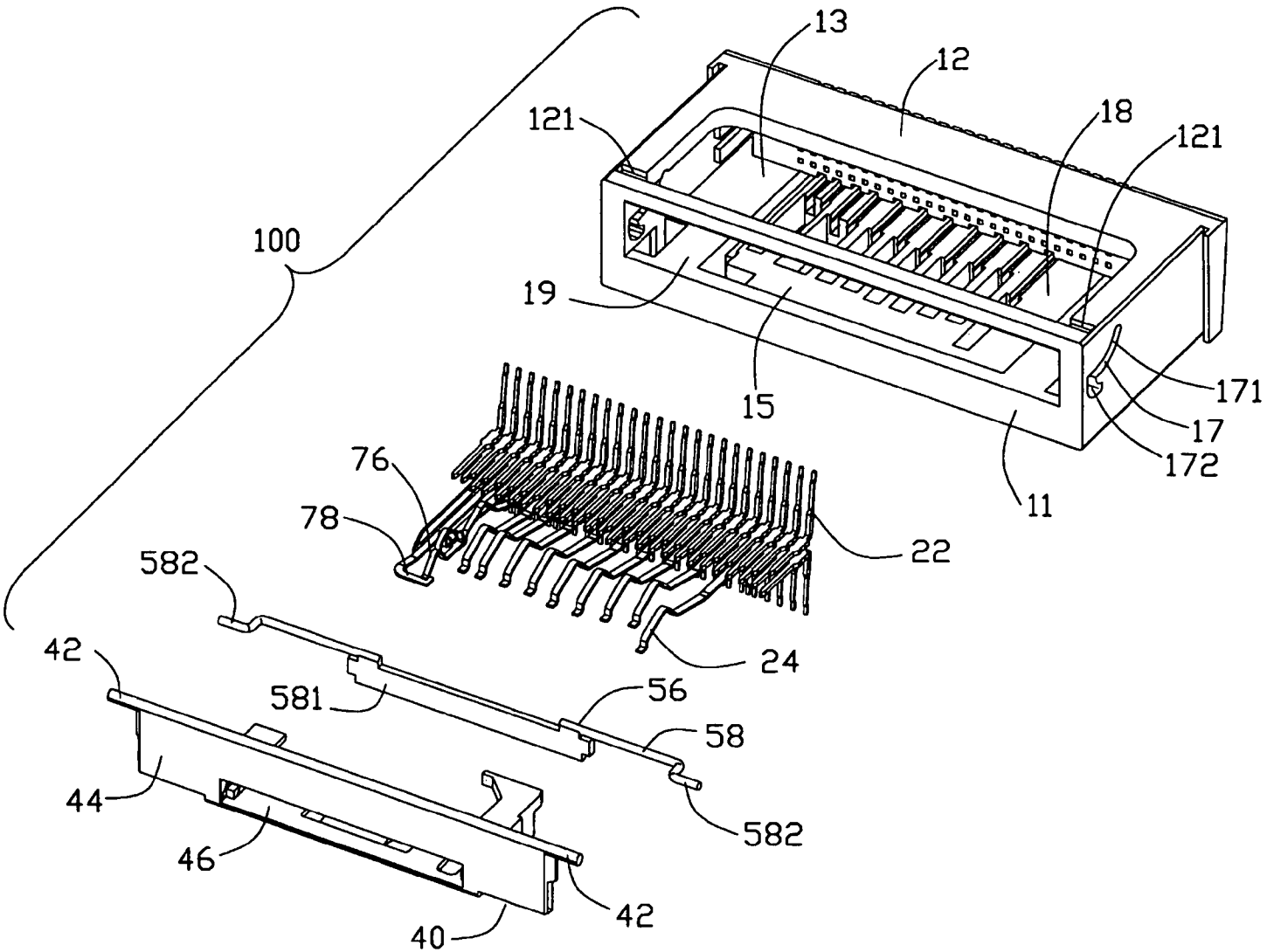
FIG. 2 is an exploded, perspective view of the card connector of FIG. 1.
Figure 3:
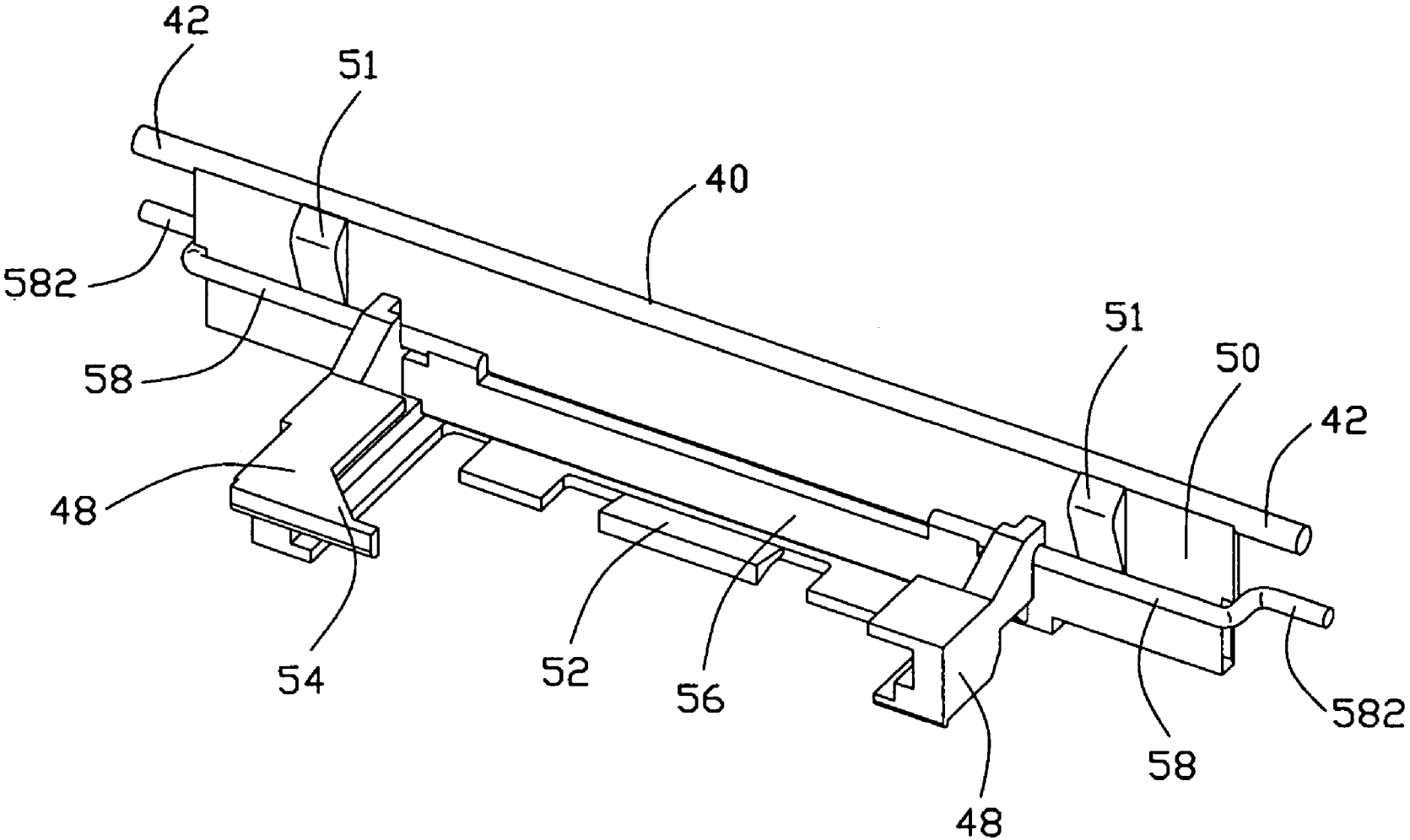
FIG. 3 is an assembled, perspective view of a protection door and a pivotal door of the card connector of FIG. 1.

Referring to FIGS. 2 and 3, a protection door 40 having two opposite pivots 42 thereon, is pivotally received in the recesses 121 of the top wall 12 of the housing 10 to moveably block the first entrance opening 19. The protection door 40 comprises a front plate 44 defining a cutout to form a second entrance opening 46 therein wherein in this preferred embodiment the second entrance opening 46 is essentially overlapped with a portion of the first entrance opening 19 and smaller than the first entrance opening 19. A pair of guiding rails 48 extend rearward from a back surface 50 of the front plate 44 at positions right beside the second entrance opening 46. A supporting plate 52 integrally extends rearward from a bottom edge of the front plate 44 so as to cooperate with the pair of guiding rails 48 to hold the inserted second card in position. A card stopper 54 is formed at the rear end of one of the guiding rails 48 for engagement with a distal end of the second card. A pair of protrusions 51 are formed on an upper portion of the back surface 50.

A pivotal door 56 having two positioning members 58 thereon, is pivotally mounted to the back surface 50 of the front plate 44 of the protection door 40 adjacent to the second entrance opening 46. The pivotal door 56 moveably blocks the second entrance opening 46 on the back surface 50 of the front plate 44. Each of the positioning members 58 is formed with a positioning portion 582 at a free end thereof.

Referring to FIGS. 1–6, the top wall 12 of the housing 10 defines therein an opening 13 to accommodate the protection door 40 therein when the protection door 40 is upwardly raised by the first card. The bottom wall 14 of the housing 10 defines therein a recess 15 to accommodate the supporting plate 52 when the protection door 40 is in a closed position where the second card can be inserted into the receiving space 18.

When no card is received in the receiving space 18, the protection door 40 in the closed position to cover the first entrance opening 19 under a condition that the pivotal door 56 is in a vertical portion to cover the second entrance opening 46. The positioning portion 582 of the pivotal door 56 is exposed into a connection of the first groove section 171 and the second groove section 172 of the groove 17. Under this situation, when the first card 300 is inserted into the receiving space 18 through the first entrance opening 19, the first card 300 pushes and upwardly raises the protection door 40 under a pivotal manner to have the guiding rails 48 pass through the opening 13 of the top wall 12, and then have the front plate 44 essentially located in a horizontal position. In this course, the positioning portions 582 of the positioning members 58 move into the first groove section 171 of the groove 17 and finally position at a distal end of the first groove section 171.

When the first card is withdrawn from the housing 10 via a reverse procedure, the protection door 40 is pushed back to the original closed position by its own gravity. Certainly, the card connector can be formed with a resilient member to urge the protection door 40 to the original closed position from an opening position.

Oppositely, if no first card 300 is available, a second card is also allowed to be inserted into the receiving space 18 via the second entrance opening 46 wherein the pivotal door 56 is upwardly raised by the inserted second card to a horizontal position. In this course, the inserted second card is positioned by the guiding rails 48. The bottom plate 52 serves to support the card-cage (made up of 48 and 54) in the horizontal position. On the other hand, the positioning portions 582 of the positioning members 58 move into the second groove section 172 of the groove 17 from the connection the first and second groove sections 171, 172, and the positioning portions 582 are positioned at a distal end of the groove section 172 finally to prevent the protection door from opening because a length of the second groove section 172 is smaller than that of the first groove section 171 along a front-to-rear direction and the positioning member 58 is disposed on the protection door 40.

When the second card is withdraw from the housing 10, the pivotal door 56 is pushed back to the closed position by its own gravity. Certainly, the pivotal door 56 can return to the closed position by a restoration force generated by a resilient member.

Figure 4:
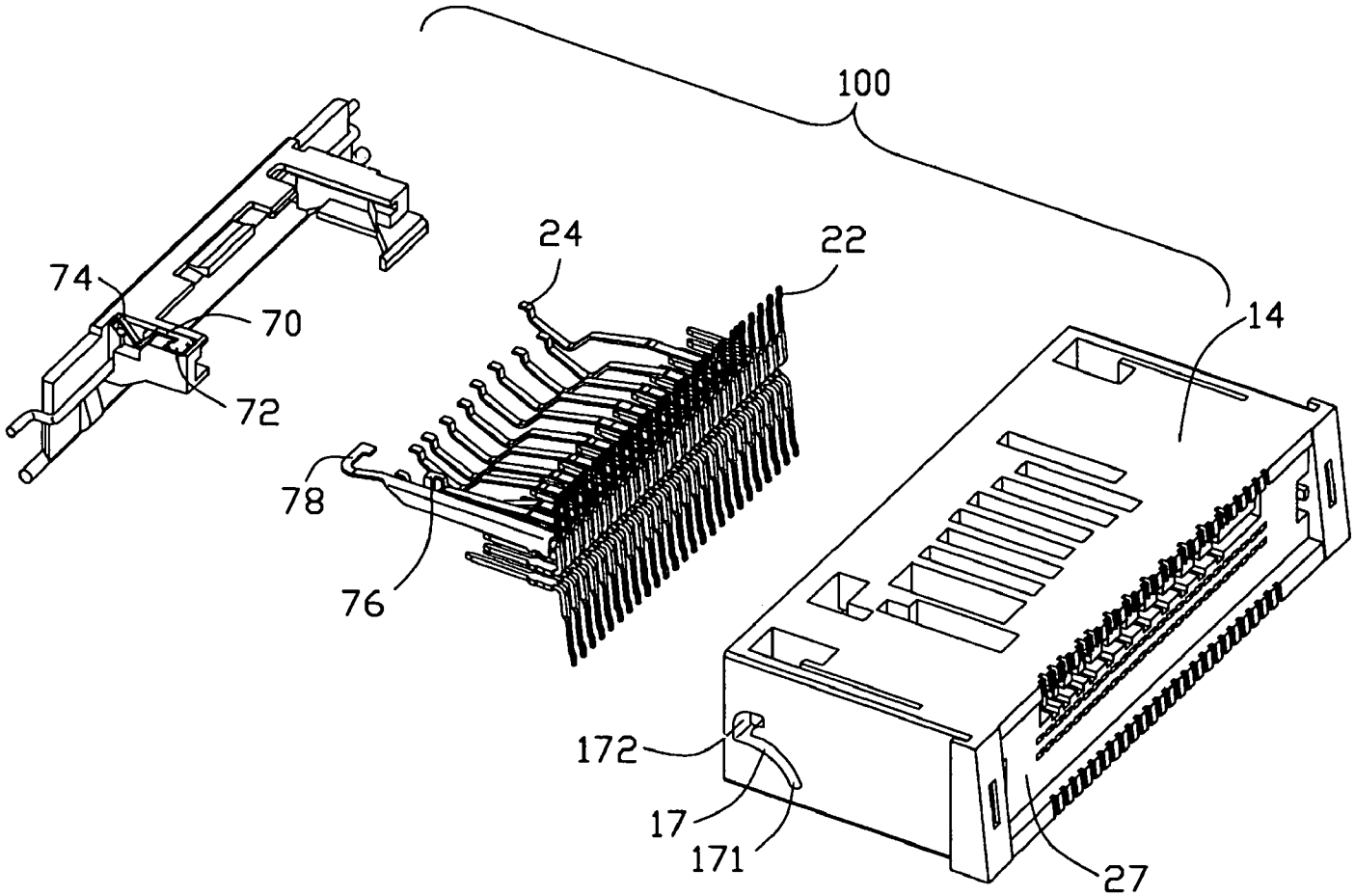
FIG. 4 is an assembled, perspective view similar to FIG. 2, but taken from another aspect.
Figure 5:
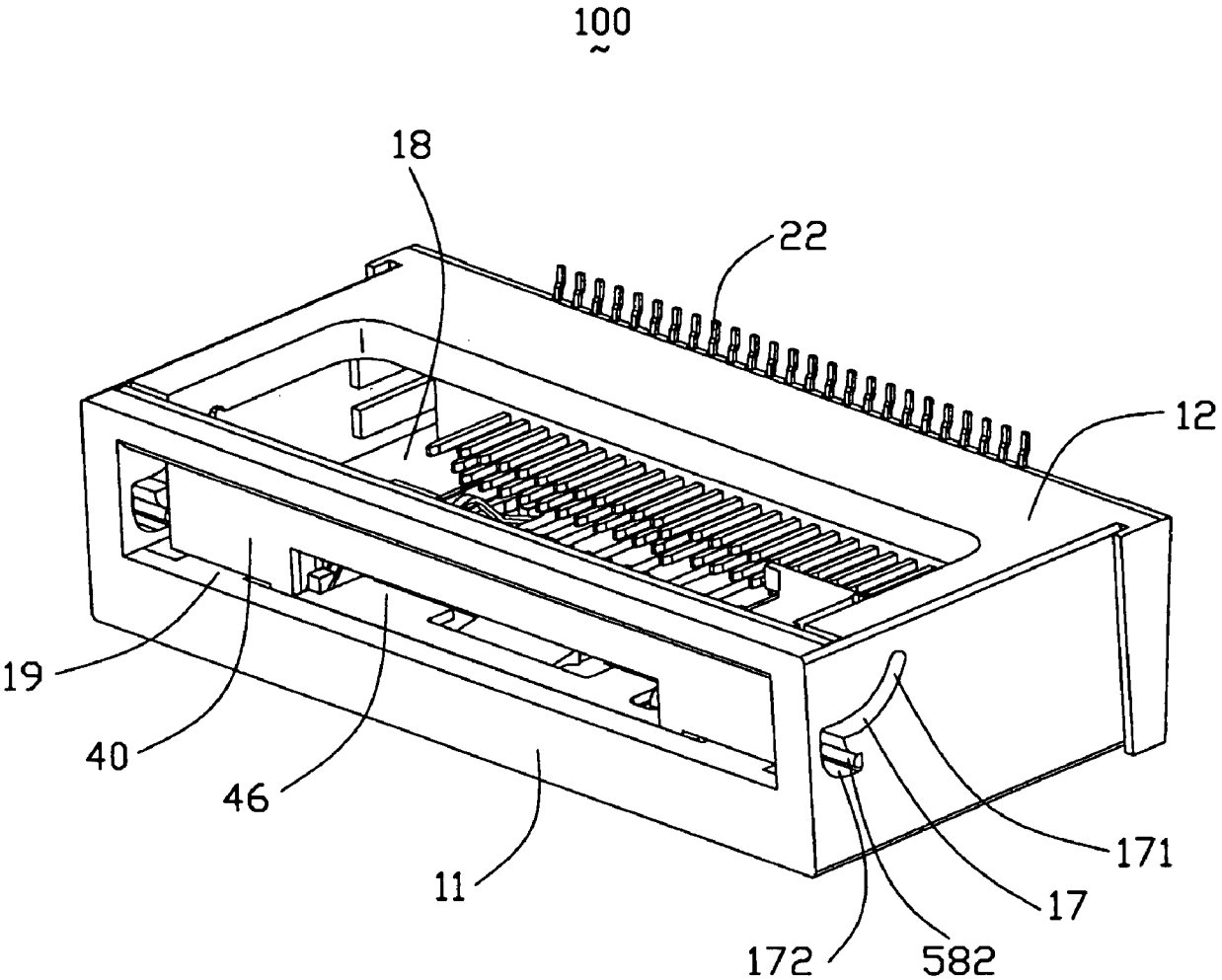
FIG. 5 is an assembled, perspective view of the card connector of FIG. 1 wherein the pivotal door is in an open position.
Figure 6:
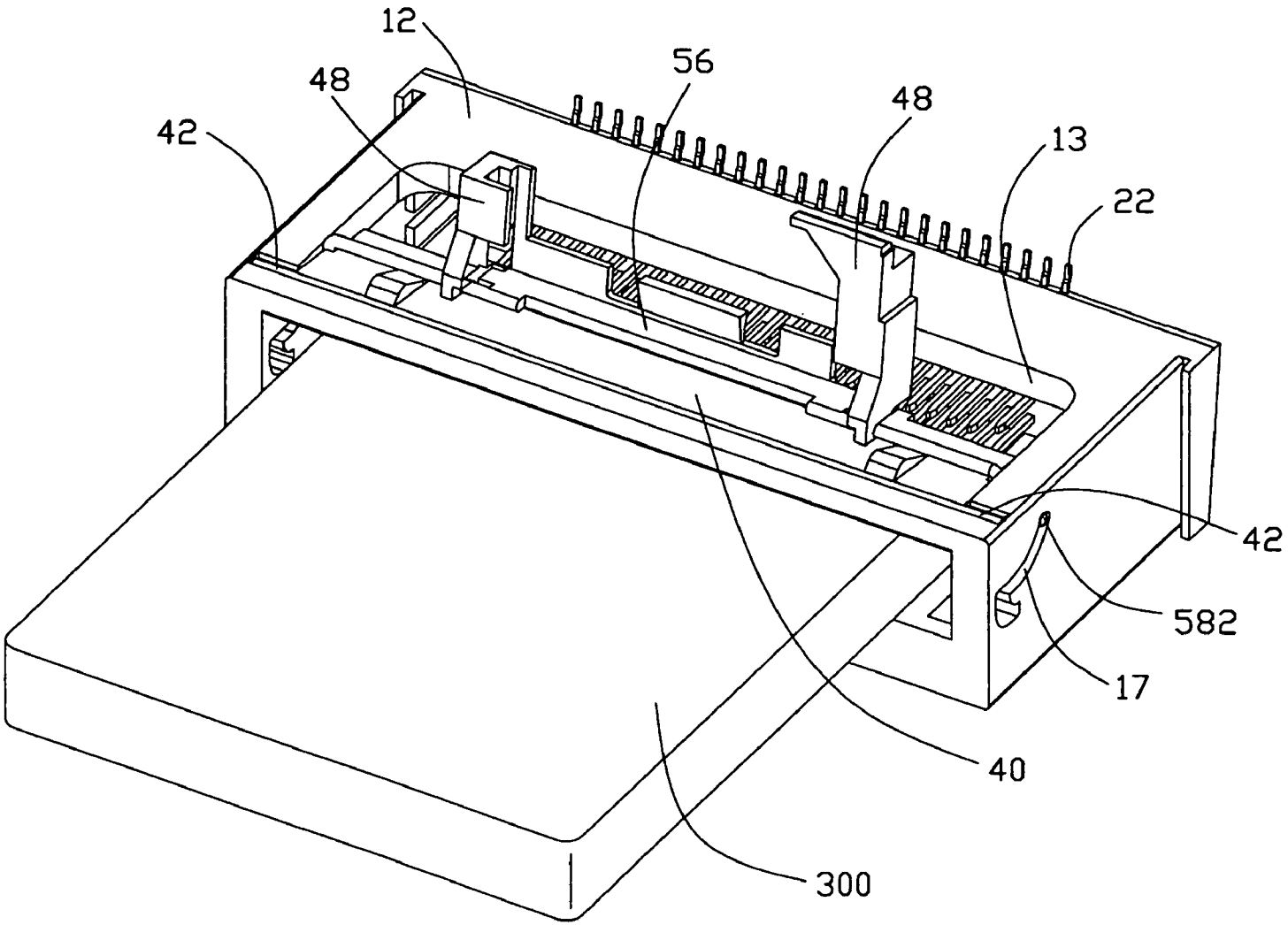
FIG. 6 is an assembled, perspective view of the card connector of FIG. 1, showing an insertion state of a first card.

Referring to FIG. 4, a moveable first switch contact 70 is associated located on the protection door 40 having a first contact end 72 and a second contact end 74. A stationary second switch contact 76 and a third switch contact 78 are disposed in the insulating housing 10. The second switch contact 76 comprises a contact section adapted to engage with the first contact end 72 of the first switch contact 70 when the protection door 40 is in the closed position. The third switch contact 78 is adapted to engage with the second contact end 74 of the first switch contact 70 when the protection door 40 is in the closed position and the second card pushed rearward away the pivotal door 56 and is inserted into the second entrance opening 46.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector comprising:

an insulating housing defining a groove and a receiving space with a first entrance opening;

first and second sets of contacts retained in the insulating housing and exposed in the receiving space;

a protection door moveably covering the first entrance opening for receiving a first card and defining a second entrance opening smaller than the first entrance opening therein for receiving a second card;

a pivotal door associated with the protection door to moveably cover the second entrance opening;

a respective positioning member having a positioning portion exposed into the groove; and when the second card is inserted in the second entrance opening, the positioning portion of the positioning member moves to one end of the groove.

2. The card connector as claimed in claim 1, wherein the positioning member is unitary with the pivot door.

3. The card connector as claimed in claim 2, wherein the positioning member is pivotally moved with respect to the protection door.

4. The card connector as claimed in claim 1, wherein the groove is formed at a sidewall of the housing.

5. The card connector as claimed in claim 4, wherein the groove comprises a first groove section and a second groove section communicating with the first groove section, and the one end of the first groove section belongs to the second groove section.

6. The card connector as claimed in claim 5, wherein the second groove section locates below the first groove section.

7. The card connector as claimed in claim 5, wherein the first and second groove sections are each actuate.

8. The card connector as claimed in claim 5, wherein a length of the first groove section is longer than that of the second groove section along a front-to-rear direction.

9. The card connector as claimed in claim 1, wherein the protection door is pivotally moveable with respect to the housing.

10. The card connector as claimed in claim 9, wherein the protection door comprises a guiding rail associatively formed on a back face of the protection door and in alignment with the second entrance opening for guidable insertion of the second card.

11. The card connector as claimed in claim 10, wherein the insulating housing has a top wall having an opening to allow the guide rail to pass through when the protection door is raised up by the first card.

12. The card connector as claimed in claim 1, wherein the positioning member is only rotatable in a fixed position relative to the protection door so as to prevent the protection door from opening when said positioning portion moves to the end of the groove.

13. A card connector comprising:

a housing defining a card receiving cavity for use with large and small cards;

first and second sets of contacts disposed in the housing for mating with the large and small cards, respectively;

a moveable large door covering a first entrance opening for receiving the large card;

a moveable small door defined in and associatively moved with the large door covering a second entrance, which is a part of the first entrance, for receiving the small card;

a positioning member commonly moved with the small door which moves in a first path when the large door is moved by the large card while in a second path when the small door is moved by the small card in a mutually exclusive manner.

14. The card connector assembly as claimed in claim 13, wherein both the large and the small door are rotated in a same direction.

15. The card connector assembly as claimed in claim 13, wherein the positioning member is commonly rotated with the small door.

16. The card connector assembly as claimed in claim 13, wherein the large door comprises a guiding rail associatively formed on a back face of the large door and in alignment with the second entrance opening for guidable insertion of the second card.

17. A card connector assembly comprising:

a housing defining a card receiving cavity for use with first and second cards;

first and second sets of contacts disposed in the housing for mating with the first and second cards, respectively;

a moveable first door covering a first entrance opening for receiving the first card;

a moveable second door associatively moved with the first door covering a second entrance, which is at least partially overlapped with the first entrance, for receiving the second card;

a positioning member commonly moved with the second door which moves in a first path when the first door is moved by the first card while in a second path when the second door is moved by the second card in a mutually exclusive manner.

18. The card connector assembly as claimed in claim 17, wherein both the first door and the second door are rotated in a same direction.

19. The card connector assembly as claimed in claim 17, wherein the positioning member is commonly rotated with the second door.

20. The card connector assembly as claimed in claim 17, wherein the first door comprises a guiding rail associatively formed on a back face of the first door and in alignment with the second entrance opening for guidable insertion of the second card.

* * * * *